United States Patent [19]

Mizelle

[11] 4,332,417

[45] Jun. 1, 1982

[54] RECLINING ACTUATOR FOR A RECLINER CHAIR

[75] Inventor: Ned W. Mizelle, Lexington, Ky.

[73] Assignee: Hoover Universal, Inc., Ann Arbor, Mich.

[21] Appl. No.: 100,951

[22] Filed: Dec. 6, 1979

[51] Int. Cl.[3] ..... A47C 1/023

[52] U.S. Cl. ..... 297/329; 297/DIG. 7; 297/68

[58] Field of Search ..... 297/329, DIG. 4, DIG. 7, 297/68, 69, 88, 71

[56] References Cited

U.S. PATENT DOCUMENTS

| | | | |
|---|---|---|---|
| 908,986 | 1/1909 | Flindall | 297/329 X |
| 2,377,649 | 6/1945 | Quinney | 297/68 |
| 2,834,397 | 5/1958 | Kluglein et al. | 297/68 |
| 2,901,026 | 8/1959 | Thaden | 297/DIG. 7 |
| 4,099,776 | 7/1978 | Crum et al. | 297/329 |

FOREIGN PATENT DOCUMENTS

| | | | |
|---|---|---|---|
| 550424 | 1/1943 | United Kingdom | 297/329 |
| 799796 | 8/1958 | United Kingdom | 297/188 |

*Primary Examiner*—James T. McCall

*Attorney, Agent, or Firm*—Olsen and Stephenson

[57] ABSTRACT

A recliner chair having a chair frame with side frame portions defining armrests, a seat structure consisting of a seat and backrest, a linkage mechanism supporting the seat structure between the side frame portions for movement between an upright seating position and a reclining position, and a reclining actuator assembly connected to the seat structure and to the chair frame operable when actuated to move the seat structure between the seating and reclining positions. The actuator assembly includes a handle positioned between one side of the seat and the side frame portion adjacent to that side of the seat for movement between a generally concealed inoperative position in which the handle is located substantially below the top surface of the seat and an operative position to move the seat structure from the seating position to the reclining position.

8 Claims, 6 Drawing Figures

RECLINING ACTUATOR FOR A RECLINER CHAIR

BACKGROUND OF THE INVENTION

The present invention relates generally to a recliner chair, and more particularly, to a recliner chair having a reclining actuator assembly manually operable for effecting a reclining movement of the recliner chair.

Those recliner chairs equipped with handle operated actuator assemblies usually position the handle on one side of the chair where it can be grasped and pivoted by the occupant to effect the reclining movement of the recliner chair. The exposed location of the handle on the side of the recliner chair presents some distinct disadvantages. An occupant of such a recliner chair may have to shift in the chair to a different position in order to reach and exert a force sufficient on the handle to recline the chair. Also, the exposed handle on the side of the chair does not add to the attractiveness of the recliner and to some is a feature so objectionable as to cause them to refrain from owning such a recliner chair.

It is the general object of this invention, therefore, to provide a reclining actuator assembly for a recliner chair having a handle located between the seat and the armrest on one side of the recliner chair. It is another object of this invention to provide a reclining actuator assembly having a handle which is positionable in a concealed position in both the seating and reclining positions of a reclining chair. It is another object of the present invention to provide a reclining actuator assembly optimally positioned with respect to the occupant of a recliner chair enabling the actuator assembly to be operated with a minimum amount of force.

SUMMARY OF THE INVENTION

The present invention provides an improved reclining actuator assembly for a recliner chair that consists of a chair frame having side frame portions defining armrests for the chair, a seat structure having a seat and backrest connected together to form a single unit, and a linkage mechanism which supports the seat structure on the chair frame between the armrests for movement between an upright seating position and a reclining position where the back of the seat structure is moved to a more horizontal position and the seat is moved forwardly to a more upright angle. The recliner chair is also equipped with a footrest that is attached to the seat structure and the linkage mechanism by a scissors linkage. The footrest is movable between a retracted upright tucked position in the seating position of the recliner chair and an extended supporting position away from the recliner chair when the seat structure is moved to a reclining position.

The reclining actuator assembly is connected to the seat structure and the chair frame and is operable when manually operated to move the seat structure from its seating position to its reclining position. The reclining actuator assembly includes a handle positioned between the seat and an armrest on one side of the recliner chair and is pivotally movable rearwardly from a forward and generally concealed inoperative position where it is located below the top surface of the seat. The handle, in its inoperative position between the seat and the armrest, is therefore in a position where it is easily grasped by the occupant to move the handle from its inoperative position by pulling it rearwardly which causes the seat structure to move from its seating to its reclining position.

The actuator assembly further includes means enabling the handle to be returned to its inoperative position after the recliner chair has attained its reclining position without causing the return movement of the seat structure to the seating position. As a result, the handle remains concealed and out of the way in both the seating and reclining positions of the recliner chair. The return movement of the seat structure to the seating position is attained by the occupant exerting a rearwardly push force against the seat structure which returns the seat structure to its seating position and which also returns the footrest to its retracted position.

Further objects, features and advantages of the present invention will become apparent from a consideration of the following description when taken in connection with the appended claims and the accompanying drawing in which:

Figure 1:
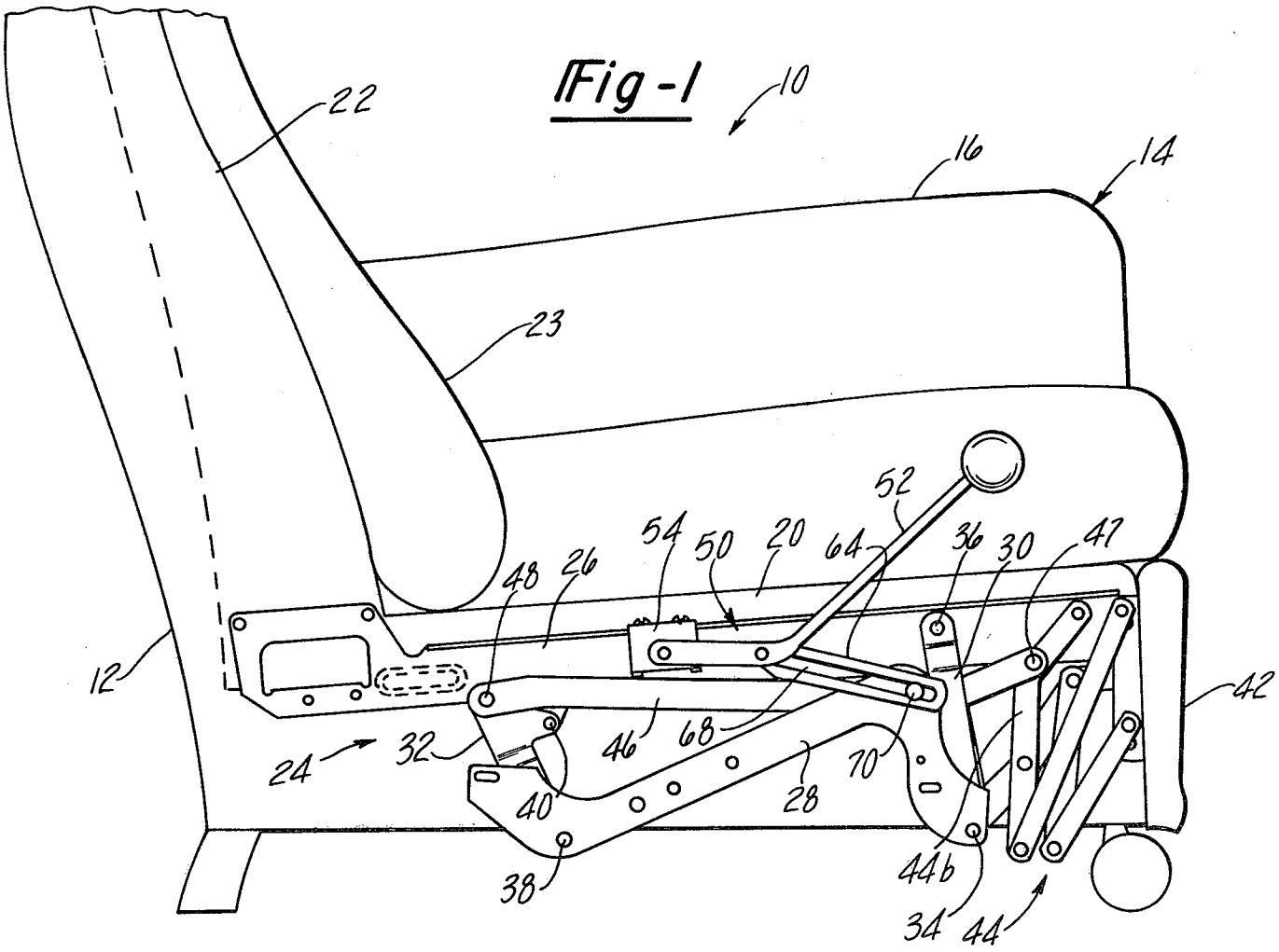
FIG. 1 is a side elevational view of a recliner chair with portions broken away to illustrate the reclining actuator assembly of the present invention in an inoperative position.

Referring to the drawing, the recliner chair 10 in which the reclining actuator assembly of the present invention is installed is shown in FIG. 1 consisting of a chair frame 12 having side frame portions 14 which define armrests 16, a seat structure 18 comprising a seat 20 fixedly connected to a backrest 22 and a lever action linkage mechanism 24 connected to a seat plate 26 which is mounted on the seat structure 18 and connected to a frame plate 28 which is fixedly mounted on the inside of one of the side frame portions 14. Upholstered seat and back cushions 21 and 23 are positioned on the seat structure 18 to provide a comfortable support for the occupant. Since the left and right sides of the recliner chair 10 are identical except for the provision of the reclining actuator assembly of the present invention on one side of the recliner chair 10, only one side of the recliner chair will be described in detail.

Figure 2:
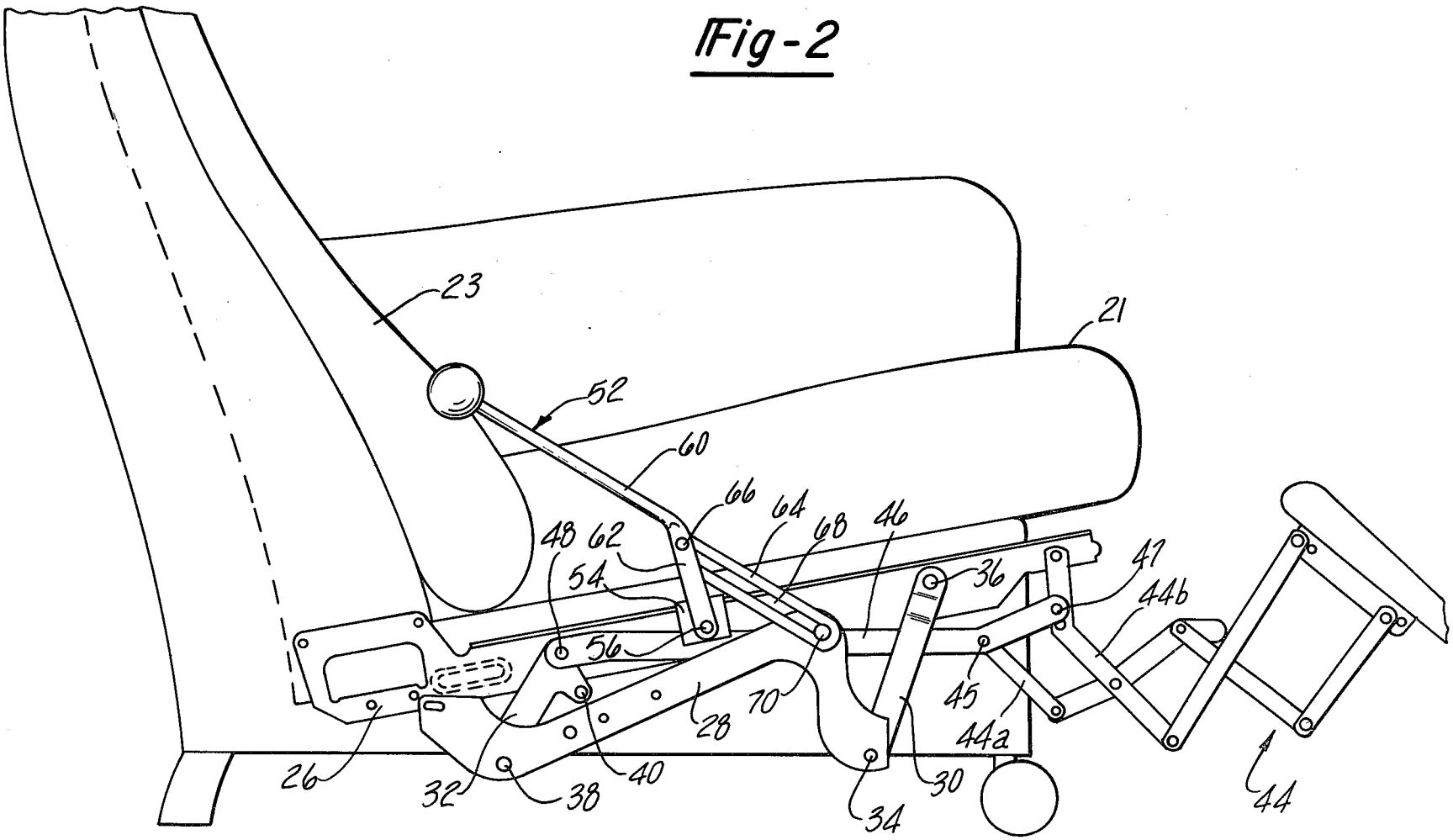
FIG. 2 is a side view of the recliner chair shown in FIG. 1 depicting the recliner chair in a fully reclined position with the handle of the actuator assembly shown in an upright operative position.
Figure 3:
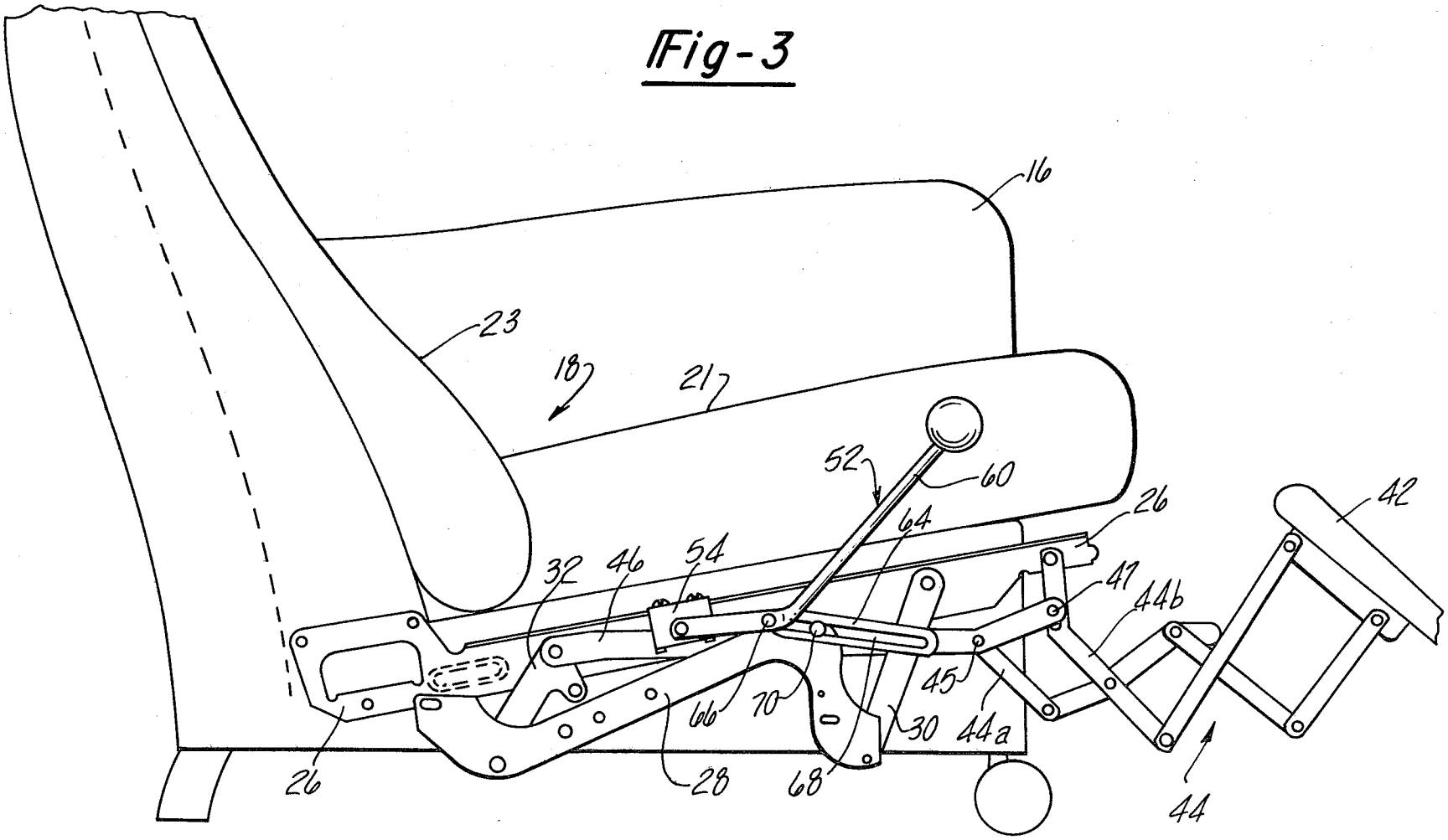
FIG. 3 is a side view of the recliner chair shown in FIG. 2 with the handle of the reclining actuator assembly shown returned to its inoperative position with the recliner chair in its fully reclined position.

The lever action linkage mechanism 24 supports the seat structure 18 between the armrests 16 for movement between an upright seating position, illustrated in FIG. 1, and a reclining position, illustrated in FIGS. 2 and 3, where the backrest 22 is moved forwardly and tilted rearwardly to a more horizontal attitude and where the seat portion 20 is tilted to a more inclined position. The recliner chair 10 in which the present invention is installed is described generally in U.S. patent application Ser. No. 648,404, filed on Jan. 12, 1976 in the name of Griefahn, now abandoned. Consequently, an explanation of the linkage mechanism 24 will be given to the extent necessary for a clear understanding of the present invention.

The linkage mechanism 24 includes operative levers 30 and 32. The forward operative lever 30 is pivotally connected at its lower end to a pivot 34 on the frame plate 28 and at its upper end to a pivot 36 on the seat plate 26. The rear operative lever 32 is pivotally connected at its lower end to a pivot 38 on the frame plate 28 and at its upper end to a pivot 40 on the seat plate 26. As can be seen in FIG. 1, the levers 30 and 32 are inclined rearwardly in the seating position of the recliner chair 10 and the lever 30 is longer than the lever 32. When the seat structure 18 is pushed forwardly to the reclining position illustrated in FIG. 2, the levers 30 and 32 are pivoted forwardly so that the backrest 22 is moved forwardly and pivoted rearwardly and the seat 20 is moved forwardly and pivoted upwardly.

The recliner chair 10 also is equipped with a footrest 42 that is attached by a scissors linkage mechanism 44 to the seat plate 26, the frame plate 28 and to a control bar 46 which is responsive to movement of the seat structure 18 relative to the chair frame 12 to extend and retract the footrest 42. The control bar 46 is connected at its rear end to a pivot 48 on the lever 32 which is spaced from the pivot 40 and at its forward end to the pivots 45 and 47 on the link members **44*a* and 44*b* of the scissors linkage 44 (see FIG. 3**).

Movement of the seat structure 18 from its FIG. 1 position to its FIG. 2 position causes the operative lever 32 to pivot clockwise about the pivots 38 and 40 to move the control bar 46 forwardly to extend the footrest 42 from its upright tucked position adjacent the chair 10 to an extended more horizontal position shown in FIG. 2. A return movement of the seat structure 18 to its FIG. 1 seating position will cause the control bar 46 to be moved to the left to pull the footrest 42 back to its tucked position as the operative lever 32 is pivoted counterclockwise about the pivot 38.

Figure 6:
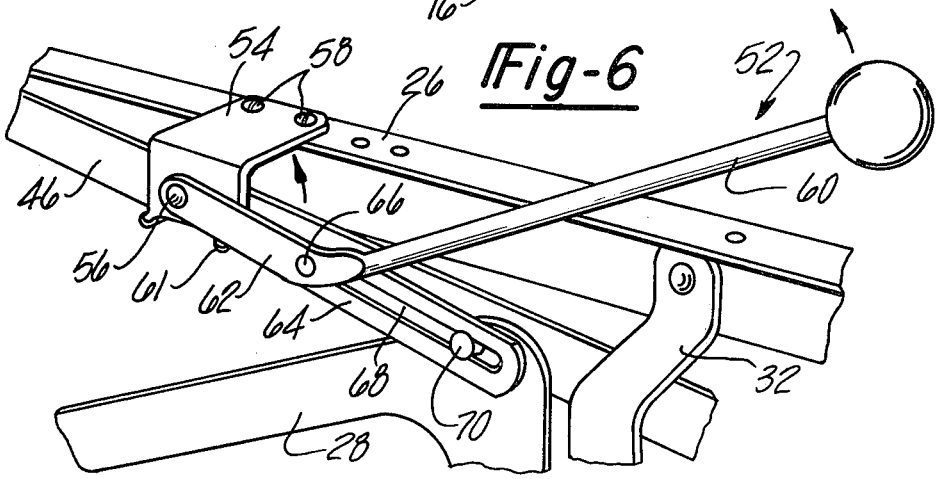

The reclining actuator assembly of the present invention, indicated generally at 50, is operable to move the seat structure 18 from the seating position shown in FIG. 1 to the reclined position shown in FIGS. 2 and 3. The reclining actuator assembly 50 (FIG. 6) includes a handle 52 pivotally mounted on the upright face of an L-shaped bracket 54 by a pin 56. The bracket 54 is located intermediate the front and rear of the seat 20 and is mounted on the seat plate 26 by screws 58. The handle 52 includes a straight main portion 60 and an offset angled portion 62. A projection 61 on the bracket 54 limits the forward pivoting movement of the handle 52 and thus defines the inoperative position of the handle 52.

A slide connector link 64 is pivotally mounted at one end to a pin 66 located at the juncture of the straight portion 60 and the angled portion 62. The slide connector link 64 has a slot 68 formed therein extending lengthwise of the link 64 and into which a pin member 70 which is mounted the chair frame 28 is disposed for movement relative to the link 64. The handle 52 is movable between an inoperative position shown in FIG. 1 and an operative position shown in FIG. 2 to move the seat structure 18 from its seating position to its reclining position shown in FIG. 2.

Figure 4:
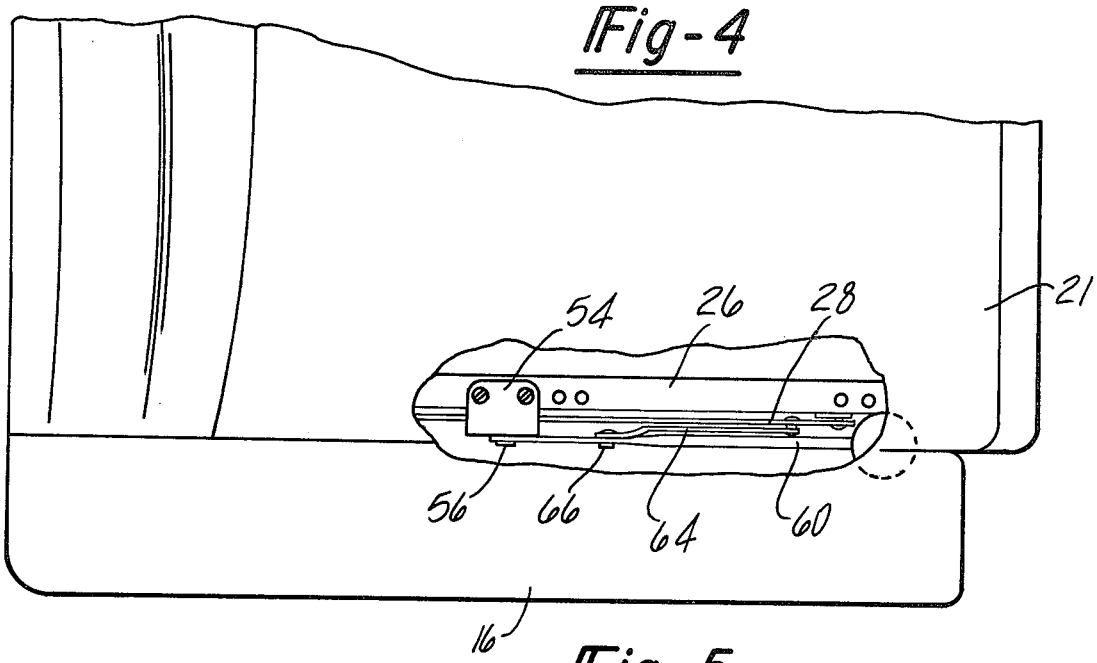
FIG. 4 is a fragmentary top plan view of the recliner chair shown in FIG. 1 with portions broken away illustrating the reclining actuator assembly in the inoperative position.

In operation, with the recliner chair 10 in its seating position, the handle 52 is located in a forward concealed inoperative position between the side of the seat cushion 21 and the adjacent armrest 16 below the top surface of the seat cushion 21 (FIGS. 1 and 4). In the inoperative position of the actuator assembly 50, the connector link 64 is positioned rearwardly relative to the pin 70 wherein a clearance exists between the pin 70 and the connector link 64 at the end of the slot 68, indicated generally at 71. When the occupant initially grasps the handle 52 and pulls it upwardly and rearwardly, the connector link 64 will also be pulled rearwardly and upwardly. The clearance between the pin 70 and the end of the slot 68 will allow the handle 52 to be moved without any initial restraining force to enable it to be pulled above the seat cushion 21 where it can be grasped firmly for further movement.

Figure 5:
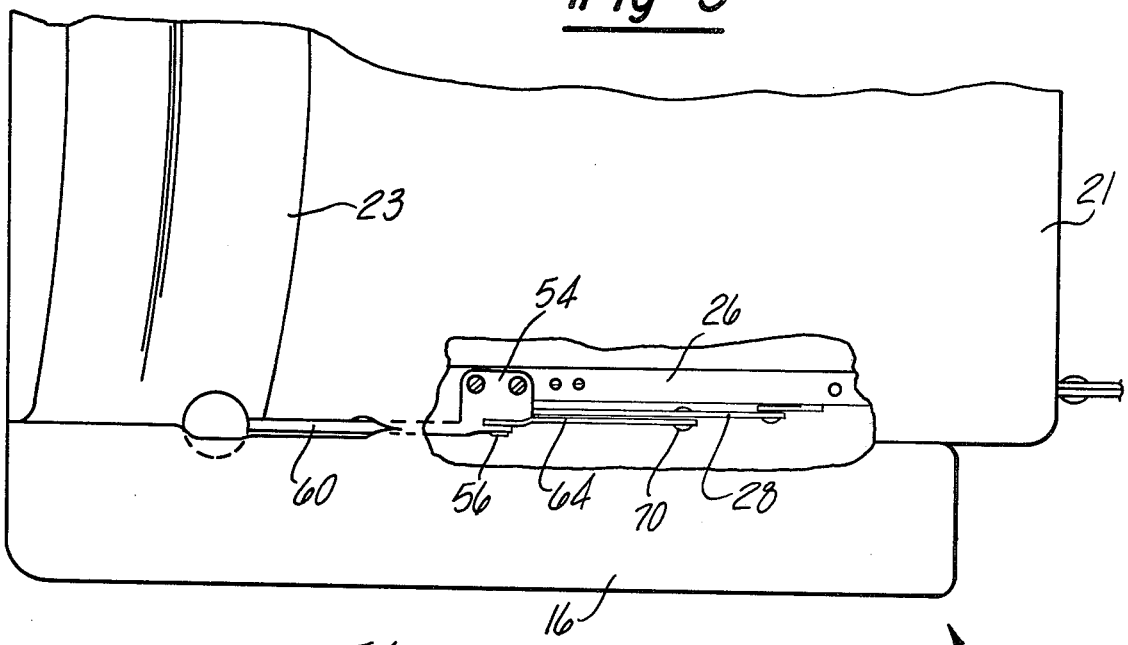
FIG. 5 is a fragmentary top plan view of the recliner chair shown in FIG. 2 with portions broken away illustrating the reclining actuator assembly in the upright operative position; and, FIG. 6 is a perspective view showing the reclining actuator assembly of the present invention.

When the pin 70 is engaged by the connector link 64 at the end 71 of the slot 68, a continued pivoting of the handle 52 counterclockwise as shown in FIG. 1 and FIG. 2 causes the seat structure 18 to be moved forwardly with respect to the frame plate 28. During this movement, the connector link 64 pivots about the pin 66. As a result, the seat structure 18 is moved to its fully reclined position shown in FIG. 2 and FIG. 5 with the handle 52 in a rearwardly position.

With the seat structure 18 in the reclined position, and the with footrest 42 extended, the occupant can return the handle 52 to the inoperative position without causing the return movement of the seat structure 18 to the seating position. The slot 68 in the connector link 64 enables this movement to be achieved by enabling the connector link 64 to be moved forwardly with respect to the pin 70 which was moved rearwardly with respect to the seat plate 26 when the chair 10 was reclined. Thus, in the reclining position shown in FIG. 3, the handle 52 is returned to its concealed out-of-the-way inoperative position. The slot 68 and pin 70 form a lost motion pivotal connection between link 64 and chair frame plate 28 enabling return of handle 52 to the inoperative position while the seat structure remains in the reclining position.

In order to return the seat structure 18 to its seating position, the occupant grasps the armrests 16 and pushes rearwardly against the backrest 22 which causes the seat structure to be returned to its seating position. The return movement of the seat structure 18 to its seating position also retracts the footrest 42. Should the handle 52 be in its operative position in FIG. 2, the return movement of the seat structure 18 to the seating position will cause the connecting link 64 to pull the handle 52 toward its inoperative position as the pin 70 is engaged with the connector link 64 at the end 71 of the slot 68. When the seat structure 18 is returned to its seating position, the occupant can push the handle 52 the remaining distance to its completely inoperative and concealed position shown in FIG. 1 as limited by the projection 61.

As can be seen from the above description, an improved reclining actuator assembly 50 is provided having a handle 52 located between the seat 20 and the armrest 16 of the recliner chair 10. Positioning the handle 52 between the seat 20 and the armrest 16 enables the occupant to easily grasp the handle 52 and operate it to move the seat structure 18 from the seating to the reclining position. Thereafter, the reclining actuator assembly 50 enables the occupant to return the handle 52 to its inoperative position so as to be concealed and out of the way in both the seating and reclining positions of the recliner chair 10. The reclining actuator assembly requires few parts, and is easily fabricated at a relatively low cost.

It is claimed:

1. In a recliner chair having a stationary chair frame with spaced apart side frame portions, and a seat structure, the improvement comprising linkage means mounting said seat structure on said chair frame between the side portions thereof for movement between a normal seating position and a reclining position, said linkage means including a frame plate attached to said frame and a seat plate attached to said seat, lever means pivotally connecting said plates, actuator means operable when manually actuated to move said seat structure between said seating and reclining positions, said actuator means including a handle pivotally connected to one of said plates and a connector link pivotally connected to said handle and to the other of said plates so that movement of said handle in one direction causes relative movement of said plates to in turn cause movement of said seat structure from a normal seating position to a reclining position, said actuator means being located on one side of said chair between said seat structure and a corresponding one of said chair frame side portions.

2. The recliner chair according to claim 1, wherein said chair frame side portions form armrests for said recliner chair, and said handle is movable from an inoperative position to an operative position to cause said seat structure to move from said seating position to said reclining position, said actuator means including means enabling said handle to be returned to said inoperative position without causing a return movement of said seat structure from said reclining position.

3. The recliner chair according to claim 2, wherein said seat structure includes a seat cushion having a top surface and sides extending generally parallel with said armrests, said handle being positioned between one of said seat cushion sides and a corresponding one of said armrests below said top surface of said seat cushion in the inoperative position of said actuator means, and being movable therefrom to said operative position above said seat cushion.

4. The recliner chair according to claim 2, wherein said handle is pivotally mounted on said seat plate and said connector link has a slot formed therein providing for a lost motion pivotal connection thereof to said frame plate.

5. The recliner chair according to claim 4, and further including a pin member fixedly mounted on said frame plate and disposed in said slot, said pin engaging said connector link at one end of said slot when said handle is moved toward the operative position to move said seat structure from the seating position to the reclining position.

6. The recliner chair according to claim 5, wherein said connector link is movable relative to said pin member in response to movement of said handle from said operative position to said inoperative position when said seat structure is in the reclining position.

7. In a recliner chair having a stationary frame and a seat structure, a linkage mechanism mounting said seat structure on said chair frame for movement between a normal seating position and a reclining position, said linkage means including a frame plate attached to said frame and a seat plate attached to said seat, lever means pivotally connecting said plates, handle means pivotally mounted on said seat plate and operable when manually actuated to move said seat structure between said seating and reclining positions, a connector link pivotally connected at one end to said handle means and at the other end to said frame plate so that movement of said handle in one direction causes relative movement of said plates to in turn cause movement of said seat structure from a normal seating position to a reclining position, said connector link being provided with a slot which extends between the ends thereof, pin means extending through said slot and secured to said frame plate providing for a lost motion pivotal connection of said connector link to said frame plate thereby enabling movement of said handle in an opposite direction without causing relative movement of said plates.

8. The structure according to claim 7, wherein said handle means is movable in said one direction from an inoperative position corresponding to a normal seating position of said seat structure to an operative position corresponding to a reclining position of said seat structure, said lost motion pivotal connection enabling said handle means to be moved in said opposite direction from said operative position to said inoperative position while said seat structure remains in said reclining position.

* * * * *